US005915374A

United States Patent [19]

Susany

[11] Patent Number: 5,915,374

[45] Date of Patent: Jun. 29, 1999

[54] ZERO CLEARANCE NON-VENTING FIREPLACE

[76] Inventor: Edward Susany, 13535 Market St., North Lima, Ohio 44452

[21] Appl. No.: 08/848,212

[22] Filed: Apr. 29, 1997

[51] Int. Cl.[6] ..... F23C 1/18

[52] U.S. Cl. ..... 126/500; 126/512

[58] Field of Search ..... 126/144, 149, 126/150, 500, 512, 520; 392/348

[56] References Cited

U.S. PATENT DOCUMENTS

| | | | |
|---|---|---|---|
| 363,210 | 5/1887 | Cooper | 126/500 |
| 611,179 | 9/1898 | May | 126/500 |
| 820,173 | 5/1906 | Bender | 126/500 |
| 2,101,921 | 12/1937 | Shaver | 126/144 |
| 2,107,779 | 2/1938 | Brown | 126/144 |
| 2,695,849 | 11/1954 | McMullen | 126/144 |
| 2,717,830 | 9/1955 | Bjorkman | 392/348 |
| 2,731,359 | 1/1956 | Nicholson | 126/144 |
| 2,821,975 | 2/1958 | Thulman | 126/500 |
| 2,914,107 | 11/1959 | Gaines | 126/144 |
| 3,100,734 | 8/1963 | Rex, Jr. et al. | 126/500 |
| 3,213,917 | 10/1965 | Scheppers | 126/144 |
| 3,301,249 | 1/1967 | Hendricks | 126/144 |
| 3,339,540 | 9/1967 | Kreider | 126/500 |
| 3,721,225 | 3/1973 | Tidwell | 126/500 |
| 4,169,458 | 10/1979 | Shaw . | |
| 4,252,105 | 2/1981 | Johnson . | |
| 4,287,871 | 9/1981 | Schumann et al. . | |
| 4,422,438 | 12/1983 | Scholoz et al. | 126/500 |
| 4,603,682 | 8/1986 | Maziasz | 126/500 |
| 4,686,807 | 8/1987 | Newsome | 126/500 |
| 4,805,591 | 2/1989 | Pitha | 126/500 |
| 4,924,850 | 5/1990 | Rieger | 126/500 |
| 4,984,562 | 1/1991 | Pedersen et al. | 126/500 |
| 5,263,471 | 11/1993 | Shimek et al. . | |

FOREIGN PATENT DOCUMENTS

| | | | |
|---|---|---|---|
| 2636410 | 9/1988 | France | 126/144 |
| 399878 | 4/1933 | United Kingdom | 126/500 |
| 2195761 | 4/1988 | United Kingdom | 126/500 |
| 2257783 | 1/1993 | United Kingdom | 126/512 |

OTHER PUBLICATIONS

FMI, Inc. of Santa Ana, California sales brochure No. P–N55211 dated May 1996.

*Primary Examiner*—Ira S. Lazarus
*Assistant Examiner*—David Lee
*Attorney, Agent, or Firm*—Harpman & Harpman

[57] ABSTRACT

A zero clearance fireplace and method of making same is disclosed. The fireplace unit is formed of a one-piece molded shell of non-flammable material providing a fire box and associated supporting and mounting elements. The fireplace is vacuum formed from a mineral wool slurry and binder formulation on a screen mold and dried forming a self-supporting molded one-piece unit that can be used in a zero clearance application due to its insulation and non-combustible properties.

5 Claims, 2 Drawing Sheets

ZERO CLEARANCE NON-VENTING FIREPLACE

BACKGROUND OF THE INVENTION

1. Technical Field

This device relates to fireplaces that are adapted for zero clearance installation in a structure against combustible building materials.

Fireplaces of this type typically have high efficiency gas burners and artificial logs within a fire box and are non-vented.

2. Description of Prior Art

Prior art devices of this type have relied on a variety of different designs such as a fireplace which is fabricated of metal having a double-walled fire box within and a support frame with insulation panels, see for example U.S. Pat. Nos. 4,287,871 and 4,169,458.

Other devices relied on a metal support shell with non-flammable insert panels within creating a fire box, see Pat. No. 5,263,471.

A hybrid fireplace is illustrated in U.S. Pat. No. 4,252,105 wherein ceramic cast sections are combined to form a free standing fireplace structure.

Vent free zero clearance fireplaces typically utilize fabricated metal and non-combustible insert panels with highly efficient gas burners and simulated logs to provide a simulated wood fed fireplace manufactured, for example, by FMI, Inc. of Santa Ana, Calif. illustrated in sales brochure no. P-N55211, dated May 1996.

SUMMARY OF THE INVENTION

A one-piece monolithic zero clearance fireplace that defines an integral support and mounting structure with a fire box in a molded form. The fireplace is vacuum formed from a non-combustible slurry of mineral wood and aluminum binder on an air evacuated form. The fireplace is adapted to mount against combustible building surfaces due to the insulation and non-inflammable properties of the molded material from which it is formed.

DESCRIPTION OF THE PREFERRED EMBODIMENT

Figure 1:
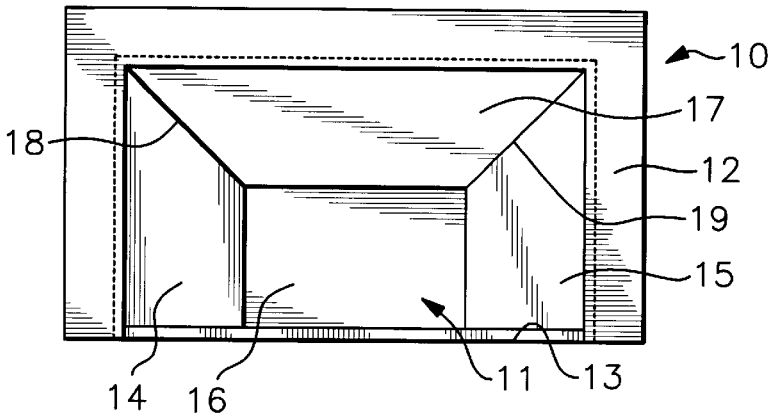
FIG. 1 is a front elevational view of the fireplace of the invention.
Figure 2:
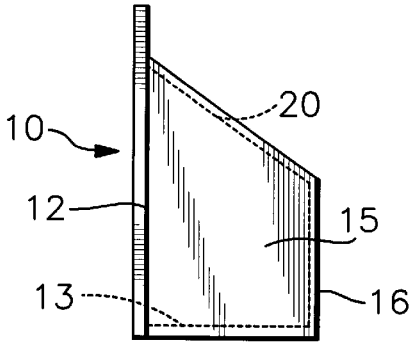
FIG. 2 is a side elevational view of the invention.
Figure 3:
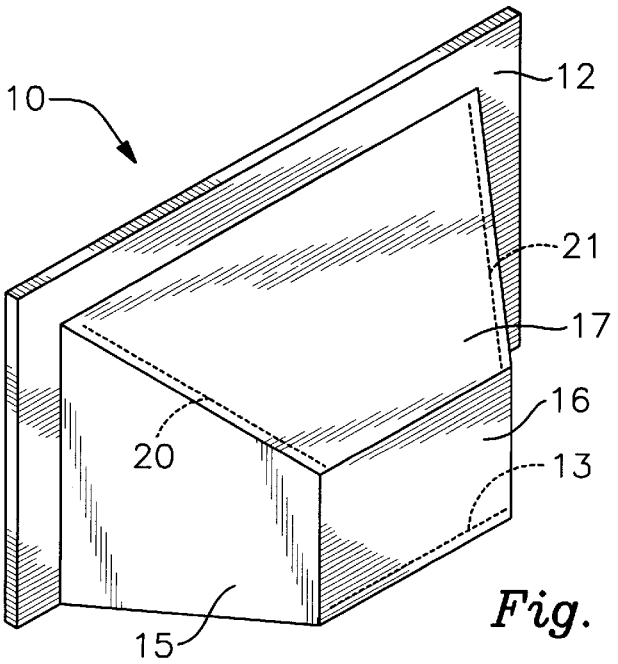
FIG. 3 is a perspective view of the fireplace illustrated in FIG. 1.
Figure 4:
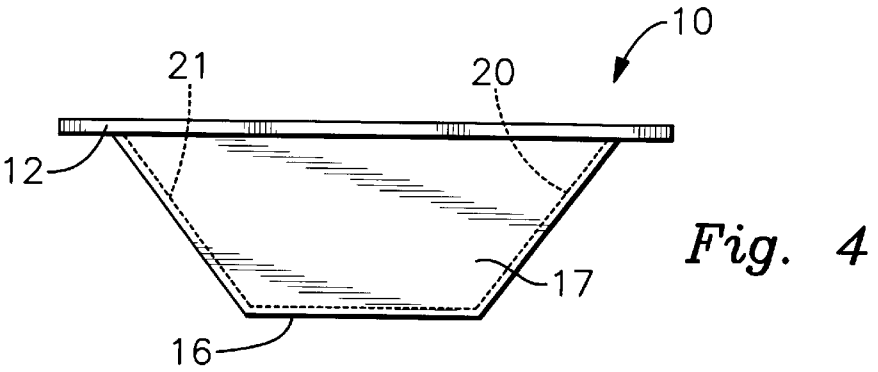
FIG. 4 is a top plan view of the fireplace of the invention.
Figure 5:
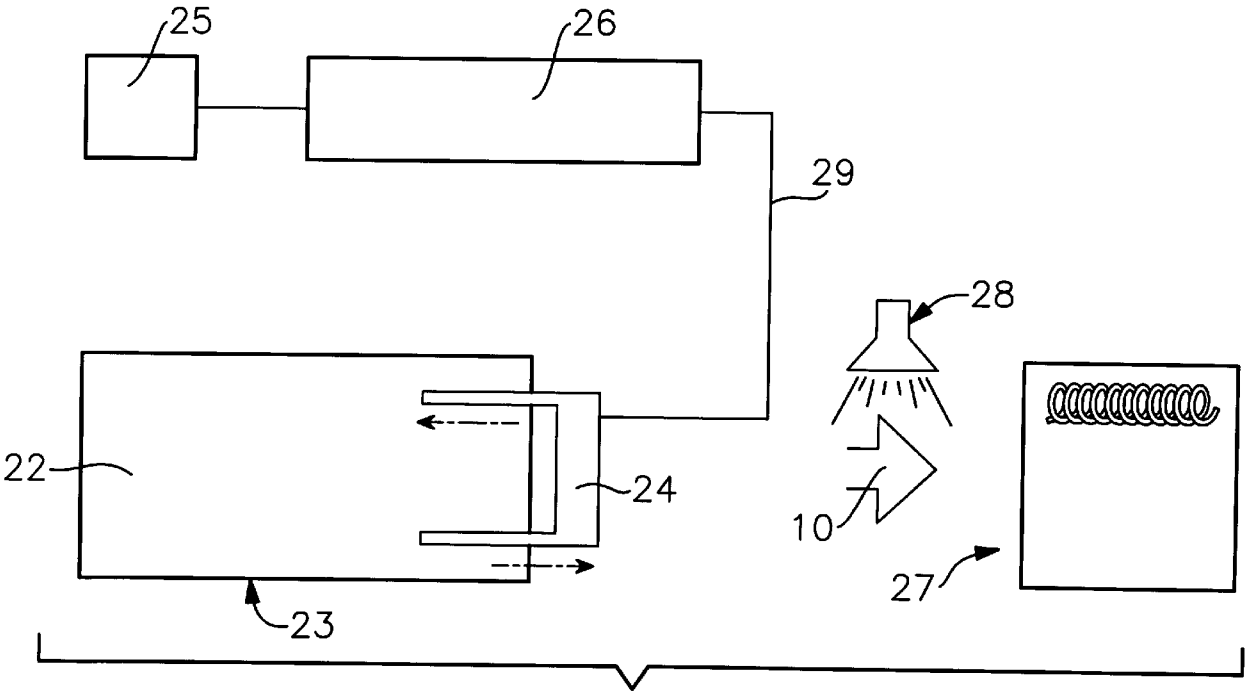
FIG. 5 is a graphic illustration of the vacuum forming steps utilized by the invention.

Referring to FIG. 1 of the drawings, a zero clearance fireplace 10 can be seen having a fire box 11 with a mounting flange 12 extending therefrom. The fire box 10 has a base 13 with an upstanding oppositely disposed sidewalls 14 and 15 and an integrally attached back wall 16. A top 17 extends from the back wall 16 to the mounting flange 12 and is of an inclined angular configuration having oppositely disposed tapered edges 18 and 19. The respective sidewalls 14 and 15 extend angularly from the back wall 16 with tapered top edges 20 and 21 that are registerable with the hereinbefore described top edges 18 and 19 of the top 17 defining an enclosure that is the fire box 11. The fireplace 10 is molded in a one-piece monolithic mass formed by a vacuum molding process generally illustrated in FIG. 5 of the drawings wherein one form of the invention a mineral wool formulation slurry 22 is used, for example, having eight pounds of mineral wool fibers, and three pounds of an aluminum based no smoke binder manufactured, for example, by West Bond Corporation under the brand name "Wesil NC". The above ingredients are combined with 100 gallons of water to form the molding slurry 22.

The aluminum binder contains calionic alumina and a small amount of organic flocculant, to flow the binder onto the mineral wool fibers within the slurry. They are, in essence, a self-contained flocking system based on the dry calionic alumina binder hereinbefore described.

The slurry 22 is held in a casting tank 23 into which a vacuum mold 24 is lowered and retrieved. A vacuum pump 25 and associated vacuum storage tank 26 provide a source of vacuum for the mold 24. Since the vacuum forming process is old and well established within the art, no additional description is deemed required for disclosure purposes.

The advantages of vacuum molding process allows for ease of wall dimensional determination and casting of a monolithic product having consistent formulation to meet exacting product performance requirements.

In the example chosen for illustration the molded fireplace 10 is released from the mold and a hardening compund HC can be selectively applied by spraying at 28 with color added, if desired, in a formulation of approximately 80% water and 20% colloidal silica as a hardener plus the color additive. The fireplace is then baked in an oven 27 for drying. A typical parts compound formulation for same would consist of five parts color, four parts water, and one part colloidal silica.

Alternate slurry formulations for vacuum molding can be used wherein refractory ceramic fibers (RCF) can be substituted for the mineral wool fibers in certain applications.

A typical formed monolithic fireplace 10 under this method for residential use has sidewalls 14 and 15 and base 13 of one inch thick material and a top 17 of one and a half inch thick material providing the adequate insulation and non-consumable properties required in a no vent zero clearance fireplace construction.

The method of forming a one-piece monolithic cast fireplace 10 of the invention is described in the following steps:

1. Preparing the molding slurry 22 based on either mineral wool or refractory fiber (RFC) combined with water and aluminum based binder in the slurry tank 23.
2. Vacuum forming using the pre-shape vacuum mold 24 interconnected to the vacuum tank 25 by a vacuum hose 29. A source of vacuum is provided by the vacuum pump 25 as is well known by those skilled in the art. A one-piece cast shape defining the fire box 11, supporting walls 14, 15 and 16, top 17 and base 13 with the mounting flange 12 is then formed and released from the mold.
3. At this point the completed mold shape is sprayed at 28 with a hardening agent and color compound, if desired, completing the formulation and casting process.
4. The completed shape is then dried in a drying oven 27 for a pre-determined amount of time at a temperature of approximately 200 degrees to achieve the rigidity and final structural support properties of the molded one-piece fireplace 10 of the invention.

It will be apparent to those skilled in the art that as with the substitution of the refractory ceramic fiber (RCF) for the mineral wool fiber, that substitute binders can also be used depending on the requirements of the particular application and therefore alternate formulations of non-combustible molded compounds may be used achieving a similar result well within the scope of the invention.

Having therefore illustrated and described a new and novel zero clearance fireplace apparatus and method of manufacturing, it will be obvious to those skilled in the art that various changes and modifications may be made thereto without departing from the spirit of the invention.

Therefore I claim:

1. A zero clearance fireplace for use in structures, said fireplace comprising; a non-vented monolithic one-piece fire box having a base, multiple interconnected upstanding wall surfaces extending from said base, a top closure integral with and extending between said multiple wall surfaces in spaced vertical aligned relation to said base, a mounting flange extending outwardly at right angles from said respective wall surfaces and said top, said wall surfaces, top closure and base defining an access opening in said fire box, said fireplace is molded from a composition of non-flammable material having a self-supporting free standing structural rigidity when molded.

2. The fireplace of claim 1 wherein said multiple walled surfaces and said integral top are in an angular relation to one another.

3. The fireplace of claim 1 wherein said non-flammable material is formed from a slurry comprising; a combination of mineral wool, fibers, water and a binder.

4. The fireplace set forth in claim 3 wherein said binder is from a group of aluminosilicate base binder compounds containing calionic alumina and organic flocculent.

5. The apparatus set forth in claim 1 wherein said composition of non-flammable material further comprises a slurry combination of refractory ceramic fibers, water and a binder.

* * * * *